United States Patent [19]

Schaeffer

[11] Patent Number: 4,851,620

[45] Date of Patent: Jul. 25, 1989

[54] MULTIPLIER SWITCH ASSEMBLY AND METHOD OF MANUFACTURE

[75] Inventor: Maurice Schaeffer, Strasbourg, France

[73] Assignees: CGEE Alsthom, and BACO, Levallois Perret; Strasbourg, both of France

[21] Appl. No.: 155,934

[22] PCT Filed: May 6, 1987

[86] PCT No.: PCT/FR87/00149

§ 371 Date: Dec. 31, 1987

§ 102(e) Date: Dec. 31, 1987

[87] PCT Pub. No.: WO87/07075

PCT Pub. Date: Nov. 19, 1987

[30] Foreign Application Priority Data

May 6, 1986 [FR] France ..... 86 06525

[51] Int. Cl.[4] ..... H01H 9/02; H01H 19/04; H01H 21/04

[52] U.S. Cl. ..... 200/14; 200/6 R; 200/307

[58] Field of Search ..... 200/4, 5 R, 6 R, 6 B, 200/6 BB, 11 R, 14, 16 A, 17, 18, 153 LB, 303, 307

[56] References Cited

U.S. PATENT DOCUMENTS

| | | | |
|---|---|---|---|
| 3,200,208 | 8/1965 | Mastney | 200/6 R |
| 3,251,956 | 5/1966 | Rusor et al. | 200/14 |
| 4,029,914 | 6/1977 | Schmidt et al. | 200/1 R |
| 4,029,924 | 6/1977 | Frank et al. | 200/16 A |
| 4,335,288 | 6/1982 | Ludwig et al. | 200/307 |
| 4,724,287 | 2/1988 | Heng et al. | 200/14 |

FOREIGN PATENT DOCUMENTS

| | | |
|---|---|---|
| 2194032 | 2/1974 | France . |
| 1058681 | 2/1967 | United Kingdom . |

*Primary Examiner*—J. R. Scott

*Attorney, Agent, or Firm*—Sughrue, Mion, Zinn, Macpeak & Seas

[57] ABSTRACT

A multipolar rotary switch, in particular a cam switch, is constituted by a stack of wafers with the contact elements and the connection elements being received in chambers lying between end walls and intermediate walls. The end walls and the intermediate walls are provided in the form of molded parts (16) of thermoplastic material and these parts are mechanically assembled to one another and are rigidly fixed together. The molded parts (16) have lugs (50) which, during assembly, overlap the sides of the adjacent molded parts and latch behind projections (62) provided thereon. After latching, the lugs (50) are welded to the side walls of the molded parts (16) in order to provide an assembly which is rigid.

4 Claims, 3 Drawing Sheets

MULTIPLIER SWITCH ASSEMBLY AND METHOD OF MANUFACTURE

The invention relates to a multipolar rotary switch, in particular a switch having cams in the form of a stack of wafers which, together with contact elements and connection elements, are received in chambers lying between end walls and intermediate walls in the form of parts molded in plastic material, said parts being juxtaposed and rigidly interconnected in order to constitute a compact supporting block with a control shaft running along the center thereof, the molded parts being provided, for coupling purposes during assembly, with claws which are deflected during joining over adjacent molded parts and which engage behind corresponding projections. The invention also relates to a method of manufacturing such a switch.

BACKGROUND OF THE INVENTION

Rotary switches of the above-mentioned type are already frequently used as control devices incorporated together with other control and signalling units in control panels or desks, or in similar installations. In this case, the stack of molded wafers is generally fixed solely at one of its ends to a supporting element and must consequently have sufficient inherent strength and rigidity to withstand the stresses coming from the camshaft in order to guarantee perfect operation even after a long period in service.

In rotary wafer switches known heretofore, this strength and rigidity is obtained by taking the molded elements (which used to be made of porcelain and have more recently been made of plastic) and interconnecting them very stiffly by means of threaded rods passing through the entire stack and acting as draw rods. However, such mechanical connection is expensive in equipment and in labor, and then requires correct screw tightening to be guaranteed, which imposes subsequent verification in addition to special care during assembly.

SUMMARY OF THE INVENTION

Consequently, the present invention seeks to avoid assembly by screwing together with its associated equipment and labor costs, while nevertheless rigidly connecting the various molded parts which constitute the stator of the rotary switch with reduced costs in materials and labor.

According to the invention, this is achieved by the facts that the molded parts are made of a thermoplastic material and that after being engaged behind the projections of the adjacent molded parts, the lugs on the side walls of the molded parts are welded in order to obtain a very rigid connection.

By using the known method of snap-fastening lugs behind projections provided on the adjacent molded parts, the invention offers the advantage of easier preliminary assembly without using tools, while simultaneously setting up the conditions required for subsequent final assembly of the parts by welding said lugs to the side walls of the contiguous molded parts with the set of of these parts then forming a block which is inherently rigid. It is true that the switch can no longer be disassembled without breaking the molded parts. However, in the rare event that switching functions need to be changed or extended (which could be done in the past by reconstructing the switch), the cost saving obtained by the invention lowers the overall cost of a rotary switch to such an extent that is now feasible simply to change the entire switch.

According to a first characteristic of an advantageous embodiment of the invention, the claws are constituted in the form of flat tabs having end orifices for receiving projections fitted with slopes for sliding over. By virtue of the thinness of the lugs, this design gives rise to particularly favorable conditions for prior assembly and subsequent welding, and these can be further improved, in accordance with another characteristic of the invention by the fact that the side surfaces of the molded parts are provided with ribs in the region overlain by the lugs, said ribs and the intermediate grooves extending along the sliding direction and serving at the end of sliding initially to prevent complete latching of the lugs behind the projections, with said firm connection occuring only during welding after the ribs have softened and fused with the lugs.

In the proposed embodiment having claws in the form of flat lugs, it is particularly advantageous for each molded part to have two pairs of projections on one side to receive the lugs from contiguous molded parts, with contiguous parts being mutually offset from one another by 180° about the control shaft. As a result of this particular embodiment, smooth outer surfaces are obtained on both sides of the stack after final assembly. This also favors the welding process which is preferably performed ultrasonically in a method of manufacture in accordance with the invention for making a multipolar rotary switch of the type mentioned above, given that the smooth outer surfaces facilitate putting sonotrodes into place.

BRIEF DESCRIPTION OF THE DRAWINGS

The invention is explained in greater detail below with reference to the accompanying drawings, in which.

DETAILED DESCRIPTION OF THE INVENTION

Figure 1:
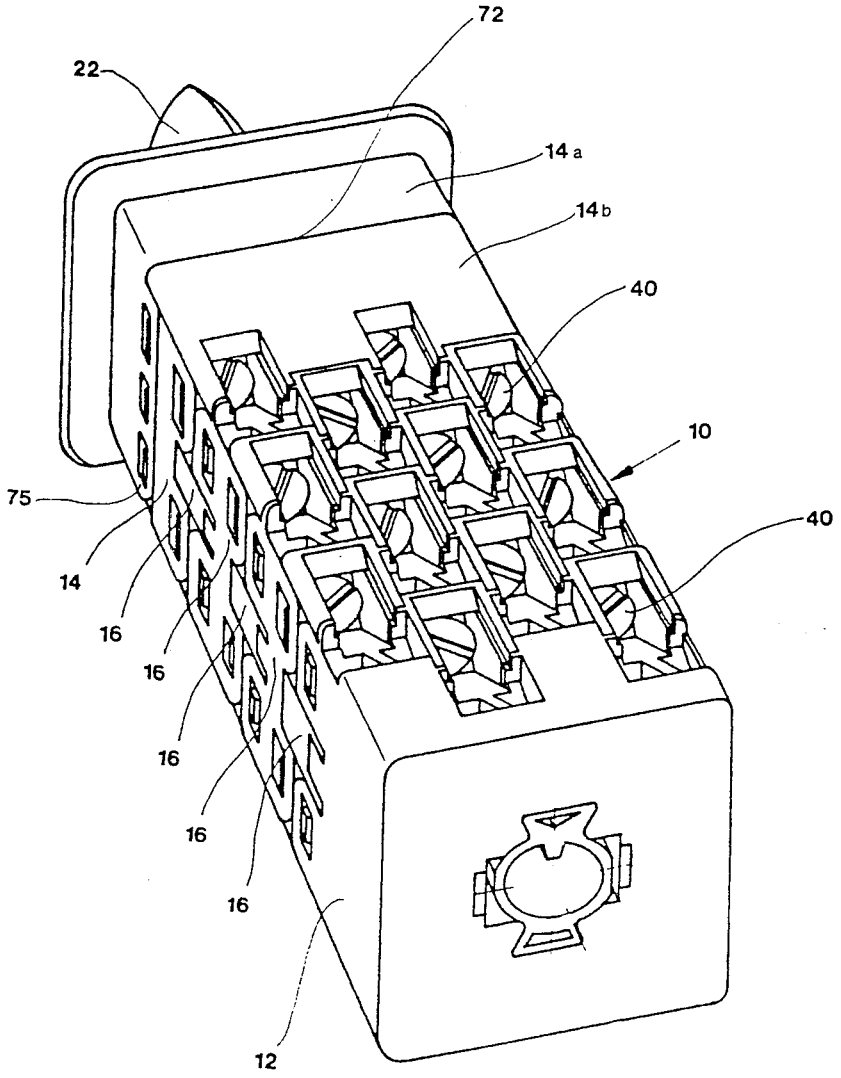
FIG. 1 is a perspective view of a switch having cams in the form of a stack of wafers.

The cam switch shown in FIG. 1 is a model having twelve poles and to this end it comprises a block 10 of modules constituted by two end modules 12 and 14 together with five intermediate modules 16 of identical design. The end modules 12 and 14 and the intermediate modules 16 are made in the form of molded parts of thermoplastic material and they constitute the end and intermediate walls for the chambers whose sides they delimit (FIG. 2) and within which, as explained below, the contact and the connection elements are received together with the cams 18 which are firmly fixed to a square section shaft 20 which is carried in bearings provided in the two end modules 12 and 14, and which is suitable for rotating together with the cams stepwise in conventional manner under the control of a knob 22.

Figure 2:
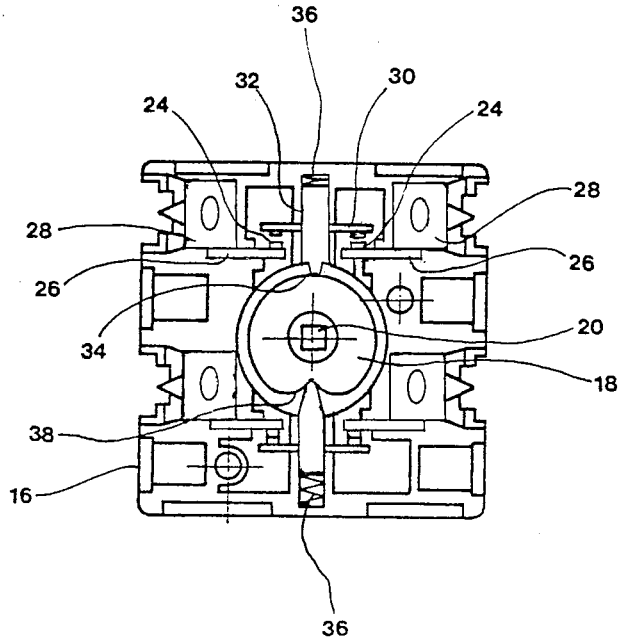
FIG. 2 is a section of the cam switch through a disconnection chamber showing the contact and the connection elements.

As can be seen more clearly in FIG. 2, two contacts are provided in each of these chambers and these contacts may be selected to be opening contacts or closing contacts, with each contact comprising a moving bridge 30 and two identical fixed elements 24 which are mechanically and electrically interconnected to connection terminals 28 by means of conducting strips 26. The moving bridge 30 is mounted on a pusher 32 whose inside end terminates in a point 34 which is pressed against the cam wafer 18 having a shaped recess 38, while its other end is resiliently biased by a helical compression spring 36. The connection terminals are provided with clamping screws 40.

Figure 3:
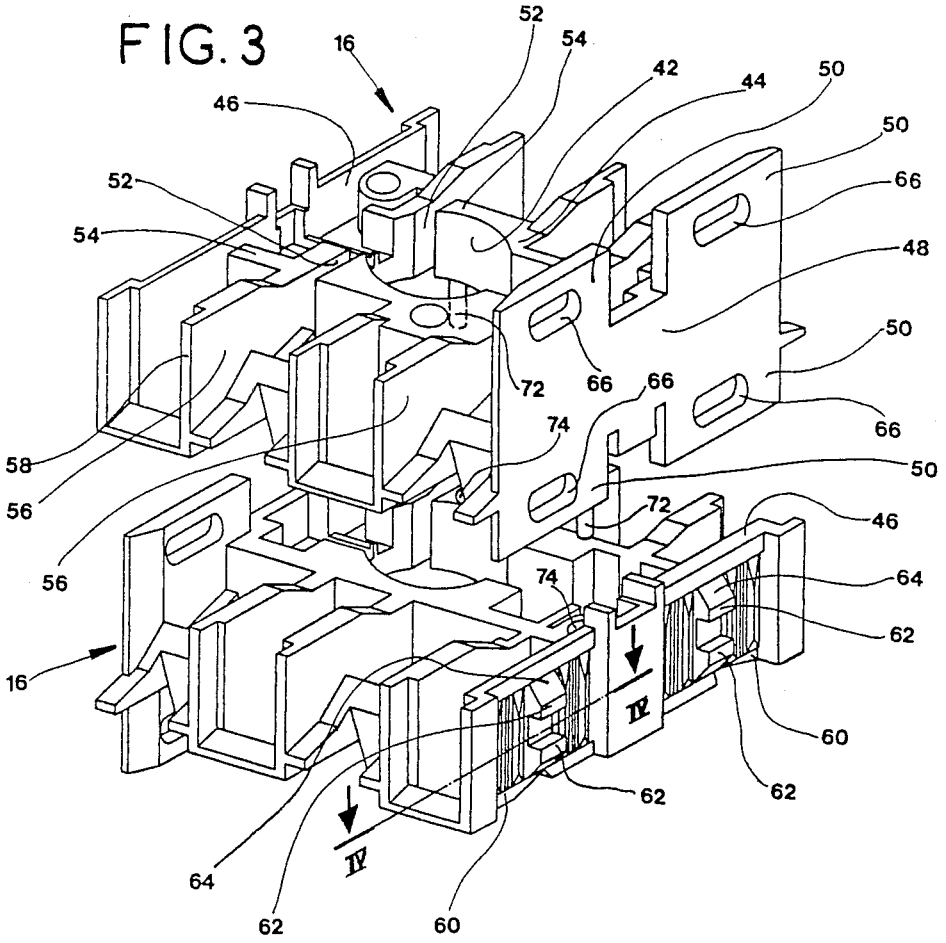
FIG. 3 is a perspective view of two parts molded in plastic material and serving as walls between chambers and as supports for the contact and connection elements, the parts being shown immediately prior to being assembled.

As shown in FIG. 3, the intermediate modules 16 have a generally square or rectangular basic shape with a central opening 42 for receiving the square section shaft 20. The opening 42 is for the most part situated in a transverse wall 44 constituting a separation and having one of the ends of a front wall 48 attached thereto, said end having two pairs of lugs 50 extending in opposite directions. The front walls 46 and 48 are interconnected on either side of the opening 42 by longitudinal walls 54 having hollows 52 and whose outside surfaces have housings 56 for receiving the connection terminals 28 on ribbed cores 58.

On their sides facing the intermediate modules, the end modules 12 and 14 are identical to the molded parts 16 and on its walls corresponding to the front walls 48 each is fitted in analogous manner with two lugs 50 only.

When stacked, the end modules 12 and 14 and the intermediate modules 16 are successively offset during assembly by an angle of 180° about the square section shaft 20 so that two of the lugs 50 pointing in the same direction on each of the molded parts 12, 14, and 16 overlap the front wall 46 of the contiguous molded part. Obviously, the other two lugs 50 on each molded part overlap the front wall of the contiguous molded part on the other side in the same manner.

The front walls 46 are provided, in their zones 60 which are covered by the lugs 52, with respective depressions including two pairs of projections 62 having sliding sloping edges 64 over which the lugs 50 of the intermediate molded parts 16 or the end modules 12 and 14 slide during assembly in order to be finally engaged behind the projections 62 via orifices 66 through the lugs 50.

Figure 4:
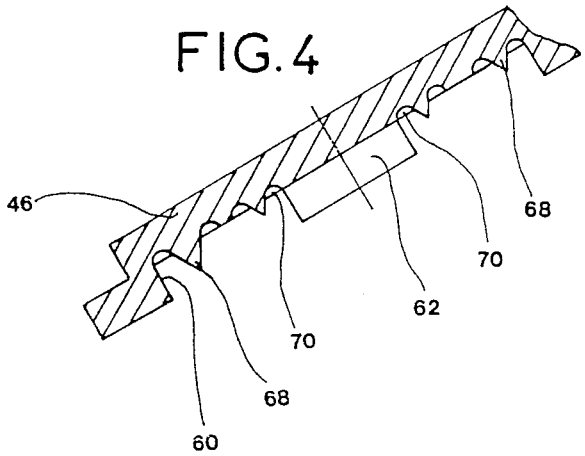
FIG. 4 is a fragmentary section through a side wall of such a molded part on line IV—IV of FIG. 3.

As can be seen particularly well in FIG. 4, ribs 68 and intermediate grooves 70 are provided on both sides of a pair of projections 62. The ribs extend in the sliding direction and the lugs 50 press resiliently against them behind the projections 62 after the lugs 50 have been put into place. This ensures that full locking does not occur initially.

Once the modules 12, 14, and 16 have been mechanically assembled with the lugs only partially engaged behind the projections 62 as explained above, an ultrasound generator (not shown) is applied via its sonotrodes to the lugs 50, thereby heating the thermoplastic material both of the molded parts in the region of the ribs 68 and the grooves 70 and of the lugs 50 against which they are pressed, thus melting the material and welding the parts together. During this process, the rib-forming material 68 flows into the grooves 70 under pressure from lugs 50, thereby allowing the lugs to relax fully and thus setting up a surface which is practically plane on both sides of the stack of modules, thereby giving rise to an assembly in the form of a rigid block which, even when fairly long, has sufficient strength and stability to withstand stresses due to the switch contacts being operated throughout the life of the switch.

On both sides of the intermediate module 16 and on one side only of the end modules 12 and 14, there are studs 72 and orifices 74 disposed asymmetrically about a mid-plane lying between the walls 48 or 46 carrying the lugs 50 or the projections 62 so that they can be received in one another only after adjacent molded parts have been turned through 180° about the square control shaft 20. This facilitates positioning the molded parts properly relative to each other during assembly, and assembly errors are eliminated.

As shown in FIG. 1, the end module 14 comprises two parts 14a and 14b having a join line therebetween, and these two parts together form a chamber (not shown) for receiving a notch mechanism for the control shaft, thereby enabling the switch to be indexed into well determined positions. The parts 14a and 14b are interconnected in principle in the same way as the modules 12 and 14 are connected to the intermediate module 16, but it should be specified that instead of having lugs 50 placed side-by-side, through lugs 75 are provided with three passages corresponding to the orifices 66, and the middle passage has no particular function.

I claim:

1. A multipolar rotary switch comprising:

a stack of interconnected plastic modules each having a central aperture aligned with the central aperture of an adjacent module to define an axially extending bore, switch means mounted on each module and cam shaft means rotatably disposed in said bore for operating said switch means, wherein each of said modules is identical and is provided with deflectable claws on one side thereof extending parallel to said bore in overlying relation to adjacent modules with each claw having orifices therein, each module having projections protruding from an opposite side thereof which mate with said orifices in a claw on an adjacent module upon axial engagement of adjacent modules, said side having said projections further having a plurality of grooves and ribs extending parallel to said bore with said ribs projecting outwardly from said opposite side in engagement with a claw which is disposed in overlying relation with said ribs and grooves to prevent complete insertion of said projections into said orifices until the extent of projection of said ribs is reduced upon welding of said ribs to said claws to provide a permanent connection between said modules.

2. A rotary switch as set forth in claim 1, wherein each module is provided with two pairs of oppositely directed claws on said one side and two pairs of projections on said opposite side, whereby each adjacent identical module is offset by 180° about said axially extending bore.

3. A rotary switch as set forth in claim 2, wherein each module is provided with a stud and a stud receptacle on opposite end surfaces disposed asymmetrically about a mid plane disposed between said sides carrying said claws and projections to prevent insertion of the stud on one module into the receptacle on the adjacent module unless said adjacent modules have been rotated through 180° relative to each other about said bore.

4. A rotary switch as set forth in claim 1, further comprising an end module located at each end of said stack and connected to an adjacent module in said stack by first connection means, one of said end modules being comprised of two parts defining a housing for a detent mechanism operably associated with said cam shaft means to angularly position said cam shaft means, said two parts being connected by second connection means, wherein said first and second connection means are comprised of complementary projections and claws similar to the projections and claws on said interconnected modules.

* * * * *